US011199386B2

(12) United States Patent
Riess

(10) Patent No.: US 11,199,386 B2
(45) Date of Patent: Dec. 14, 2021

(54) PB-FREE DEFORMING/PARTIALLY FRAGMENTING PROJECTILE WITH A DEFINED MUSHROOMING AND FRAGMENTING BEHAVIOR

(71) Applicant: RUAG AMMOTEC GMBH, Fürth (DE)

(72) Inventor: Heinz Riess, Fürth (DE)

(73) Assignee: RUAG AMMOTEC AG, Fuerth (DE)

( * ) Notice: Subject to any disclaimer, the term of this patent is extended or adjusted under 35 U.S.C. 154(b) by 0 days.

(21) Appl. No.: 15/117,125

(22) PCT Filed: Feb. 10, 2015

(86) PCT No.: PCT/EP2015/052778
§ 371 (c)(1),
(2) Date: May 16, 2017

(87) PCT Pub. No.: WO2015/118173
PCT Pub. Date: Aug. 13, 2015

(65) Prior Publication Data

US 2017/0248396 A1 Aug. 31, 2017

(30) Foreign Application Priority Data

Feb. 10, 2014 (DE) ..... 10 2014 001 612.9

(51) Int. Cl.
*F42B 12/34* (2006.01)
*F42B 12/06* (2006.01)
(Continued)

(52) U.S. Cl.
CPC ..... *F42B 12/34* (2013.01); *F42B 12/06* (2013.01); *F42B 12/367* (2013.01); *F42B 12/74* (2013.01)

(58) Field of Classification Search
CPC ..... F42B 12/34; F42B 12/367; F42B 12/74; F42B 12/745; F42B 30/02
(Continued)

(56) References Cited

U.S. PATENT DOCUMENTS 949,028 A * 2/1910 Ross ..... F42B 12/34 102/510
1,023,469 A * 4/1912 Haslett ..... F42B 12/34 102/510
(Continued)

FOREIGN PATENT DOCUMENTS

DE 199 30 473 A1 1/2001
DE 103 17 404 A1 11/2003
(Continued)

OTHER PUBLICATIONS

NPL, https://www.swiftbullets.com/pages/bullets.*
International Search Report for PCT/EP2015/052778 dated Apr. 22, 2015; English translation submitted herewith (7 Pages).

*Primary Examiner* — John Cooper
(74) *Attorney, Agent, or Firm* — Fitch, Even, Tabin & Flannery LLP

(57) ABSTRACT

The invention relates to a Pb-free deforming/partially fragmenting projectile with a projectile body. In order to improve the killing effect of the projectile, the projectile has a fragmenting core according to the invention. The projectile body is equipped with a bore which is arranged on the longitudinal axis, extends from the tip of the projectile body, and extends into the interior, and the projectile body tip, which faces away from the projectile base has a bevel which extends from the outer circumference of the projectile body to the bore and runs at an acute angle to the longitudinal axis. The fragmenting core has a cylindrical part and a head part. The cylindrical part is arranged in the bore, and the head part protrudes out of the bore and has a support surface which is
(Continued)

adapted to the bevel in the projectile body and together with the support surface rests on the bevel of the projectile body. The head part has a rounded tip which forms the tip of the projectile.

10 Claims, 3 Drawing Sheets

(51) Int. Cl.
*F42B 12/36* (2006.01)
*F42B 12/74* (2006.01)

(58) Field of Classification Search
USPC ..... 102/507–510
See application file for complete search history.

(56) References Cited

U.S. PATENT DOCUMENTS 1,135,357 A * 4/1915 Clyne ..... F42B 12/34 102/508
1,322,662 A * 11/1919 Watson ..... F42B 12/34 102/510
1,447,478 A * 3/1923 Koshollekemilj ..... F42B 12/34 102/508
1,556,160 A * 10/1925 Riggs ..... F42B 12/34 102/510
3,208,386 A * 9/1965 Schneider ..... F42B 12/34 102/506
4,044,685 A * 8/1977 Avcin ..... F42B 12/34 102/508
4,655,140 A * 4/1987 Schirneker ..... F42B 10/22 102/508
4,685,397 A * 8/1987 Schirneker ..... F42B 12/34 102/501
5,679,920 A * 10/1997 Hallis ..... F42B 12/74 102/398
5,789,698 A * 8/1998 Beal ..... F42B 12/74 102/506
5,801,324 A * 9/1998 Pickard ..... F42B 12/34 102/506
5,852,255 A * 12/1998 Hallis ..... F42B 12/74 102/439
6,158,350 A * 12/2000 Pulcini ..... F42B 12/74 102/501
6,371,029 B1 * 4/2002 Beal ..... F42B 12/74 102/506
6,694,888 B2 * 2/2004 Jopson ..... F42B 7/08 102/506
6,776,101 B1 * 8/2004 Pickard ..... F42B 12/34 102/507
6,776,818 B1 * 8/2004 Nilsson ..... F42B 12/74 102/517
6,971,315 B2 * 12/2005 Knappworst ..... F42B 12/34 102/508
7,150,233 B1 * 12/2006 Eberhart ..... F42B 12/74 102/516
7,299,750 B2 * 11/2007 Schikora ..... F42B 12/34 102/506
7,373,887 B2 * 5/2008 Jackson ..... F42B 12/34 102/510
7,966,937 B1 * 6/2011 Jackson ..... F42B 12/74 102/501
8,161,885 B1 * 4/2012 Emary ..... F42B 12/34 102/506
9,052,174 B2 * 6/2015 Dennison ..... F42B 10/02
9,200,877 B1 * 12/2015 Rubin ..... F42B 12/36
9,255,775 B1 * 2/2016 Rubin ..... F42B 12/36
9,354,027 B2 * 5/2016 Flint ..... F42B 12/367
2002/0117074 A1 * 8/2002 Beal ..... F42B 12/74 102/516
2002/0139275 A1 * 10/2002 Jensen ..... F42B 12/56 102/510
2002/0152915 A1 * 10/2002 Vaughn ..... F42B 12/34 102/507
2002/0178963 A1 * 12/2002 Halverson ..... F42B 30/02 102/516
2003/0089264 A1 * 5/2003 Eberhart ..... F42B 12/34 102/510
2004/0003747 A1 * 1/2004 Hietanen ..... F42B 12/34 102/510
2004/0016357 A1 * 1/2004 Beal ..... F42B 10/46 102/519
2004/0129165 A1 * 7/2004 Cesaroni ..... F42B 12/745 102/516
2004/0159262 A1 * 8/2004 LeaSure ..... F42B 12/34 102/517
2005/0211126 A1 * 9/2005 Hurley ..... F42B 12/46 102/517
2006/0011086 A1 * 1/2006 Rose ..... F42B 12/06 102/364
2006/0081148 A1 * 4/2006 Beal ..... F42B 5/16 102/441
2006/0107863 A1 * 5/2006 Powers, Jr. ..... F42B 8/12 102/517
2007/0017409 A1 * 1/2007 Mansfield ..... F42B 12/06 102/518
2007/0089629 A1 * 4/2007 Marx ..... F42B 12/34 102/524
2008/0035008 A1 * 2/2008 Riess ..... F42B 12/06 102/518
2008/0196616 A1 * 8/2008 Cziglenyi ..... F42B 12/34 102/439
2008/0229963 A1 * 9/2008 Nielson ..... C06B 27/00 102/364
2010/0083861 A1 * 4/2010 Joys ..... C22C 1/0425 102/506
2010/0212535 A1 * 8/2010 Beal ..... F42B 12/367 102/517
2010/0224093 A1 * 9/2010 Wilhelm ..... F42B 12/34 102/507
2010/0263565 A1 * 10/2010 Hugus, IV ..... F42B 12/44 102/364
2011/0252997 A1 * 10/2011 Hoffman ..... F42B 12/06 102/439
2011/0308420 A1 * 12/2011 Mutascio ..... B22F 1/0007 102/513
2012/0111220 A1 * 5/2012 King ..... F42B 12/34 102/509
2012/0227615 A1 * 9/2012 Beal ..... F42B 12/367 102/516
2014/0130698 A1 * 5/2014 Trujillo ..... B23K 35/262 102/517
2015/0144019 A1 * 5/2015 Andersson ..... F42B 12/74 102/514
2015/0292845 A1 * 10/2015 Riess ..... F42B 12/34 102/506
2015/0330754 A1 * 11/2015 Bierman ..... F42B 7/00 102/522
2015/0354930 A1 * 12/2015 Fricke ..... F42B 12/34 102/439
2016/0047638 A1 * 2/2016 Golloher ..... F42B 12/34 102/501
2016/0091290 A1 * 3/2016 Sheridan ..... F42B 12/367 102/439
2016/0145166 A1 * 5/2016 Skeats ..... C06B 23/005 102/434
2016/0161232 A1 * 6/2016 Rubin ..... F42B 12/54 102/439
2016/0265889 A1 * 9/2016 Golloher ..... F42B 12/34

(56) References Cited

U.S. PATENT DOCUMENTS

| | | | | |
|---|---|---|---|---|
| 2017/0234664 | A1* | 8/2017 | Golloher | F42B 12/367<br>102/510 |
| 2017/0248396 | A1* | 8/2017 | Riess | F42B 12/06 |
| 2017/0261294 | A1* | 9/2017 | Riess | F42B 5/025 |

FOREIGN PATENT DOCUMENTS

| | | | | |
|---|---|---|---|---|
| DE | 10 2012 023398 | A1 | 6/2014 | |
| EP | 1 355 119 | A1 | 10/2003 | |
| EP | 1355119 | A1 * | 10/2003 | F42B 12/34 |
| GB | 1355119 | A1 * | 10/2003 | F42B 12/34 |

* cited by examiner

PB-FREE DEFORMING/PARTIALLY FRAGMENTING PROJECTILE WITH A DEFINED MUSHROOMING AND FRAGMENTING BEHAVIOR

CROSS-REFERENCE TO RELATED APPLICATIONS

This application is a U.S. national phase application filed under 35 U.S.C. § 371 of International Application No. PCT/EP2015/052778, filed Feb. 10, 2015, designating the United States, which claims priority from German Patent Application No. 10 2014 001 612.9, filed Feb. 10, 2014, which are hereby incorporated herein by reference in their entirety for all purposes.

BACKGROUND OF THE INVENTION

Field of the Invention

The invention relates to a lead-free deforming/partially fragmenting projectile having a projectile body. The invention is based upon a lead-free deforming/partially fragmenting projectile having a projectile body in such a way that the killing effect of the projectile is improved. The invention has a lead-free deforming/partially fragmenting projectile.

SUMMARY OF THE INVENTION

The fragmentable core is deformed on impact of the projectile with the target body and initiates the mushrooming of the projectile due to the fact that the projectile has a fragmentable core, wherein a bore is arranged on the longitudinal axis, extends from the tip of the projectile into the interior, is created in the projectile body, and the upper part of the projectile body which faces away from the base of the projectile has a beveled surface forming at an acute angle with the longitudinal axis and extends from the outside circumference of the projectile body to the bore. The fragmentable core has a cylindrical part and a head part. The cylindrical part is located in the bore and the head part protrudes out of the bore and has a support surface, which conforms to the beveled surface in the projectile body, and the head part has a rounded tip which forms the tip of the projectile. Therefore, the fragmentable core is exposed, fragments in the target body at predetermined breaking points to form multiple fragments, and damages vital organs at a distance from the shot channel. The deformed projectile body releases energy into the target body and creates the exit wound. The fragmentable part of the projectile is always defined due to the fact that the projectile body, which has a stable mass, does not lose any mass in its passage through the target body.

The weight of the fragmentable core is preferably between 3% and 30% of the weight of the projectile. The greater the weight of the fragmentable core relative to the weight of the projectile, the greater is the damage is to vital organs. If the weight of the fragmentable core amounts to 3% of the projectile weight, then there is little depth effect. However, if the weight of the fragmentable core is 30% of the projectile weight, then the depth effect is great.

The projectile body is preferably made of a deformable lead-free material or alloys thereof and is preferably made of Cu or CuZn.

The fragmentable core is preferably made of a lead-free fragmentable material, advantageously tin or pressed tin granules.

In one embodiment, the fragmentable core is provided with predetermined breaking points that define the fragments when breaking occurs at the breaking points after impact of the projectile. A preferred embodiment of a core permeated with predetermined breaking points is described in DE 10 2012 023398 A 1.

The projectile body determines the mushrooming behavior of the projectile. This takes place through the material, the shaping on the inside and/or outside with or without predetermined breaking points on the inside or outside or both. Any readily deformable lead-free material or alloys may be used as the material, e.g., Cu or CuZn.

The fragmentable core determines the response of the projectile and the defined fragmentation of the projectile core. The material is made of a lead-free readily fragmentable material such as Sn, pressed granules or cores permeated with predetermined breaking points as described in DE 10 2012 023398 A 1.

Mechanism of Action

The mushrooming and defined fragmentation of the projectile according to the invention in the target body, in particular a hunting projectile in a game animal's body after penetration into the same determines the release of energy of the projectile and thus the effect of the shot. To improve the killing effect of the deformation projectile, a fragmentable core is introduced into the deforming projectile. After impact of the projectile with the target body, the core deforms and starts the mushrooming of the projectile. This in turn exposes the fragmentable core, which fragments in the target body at the breaking points and damages vital organs at a greater distance from the shot channel. The deformed projectile body continues to release energy in the target body and creates the exit wound. Since the projectile body, which has a stable mass, does not lose any mass in its passage through the target body, the fragmentable part of the projectile is always defined. The fragmentable part (see the drawings) may amount to between 3% and 30% of the projectile weight. The greater the fragmentation in percentage relative to the projectile weight, the greater the damage is to vital organs.

The fragmentable part of the projectile weight is preferably 3% to 30%.

EXAMPLE

Projectile body 97% high release of energy
Fragmentable core 3% low depth effect
Projectile body 70% low release of energy
Fragmentable core 30% great depth effect

DETAILED DESCRIPTION OF THE INVENTION

Figure 1:
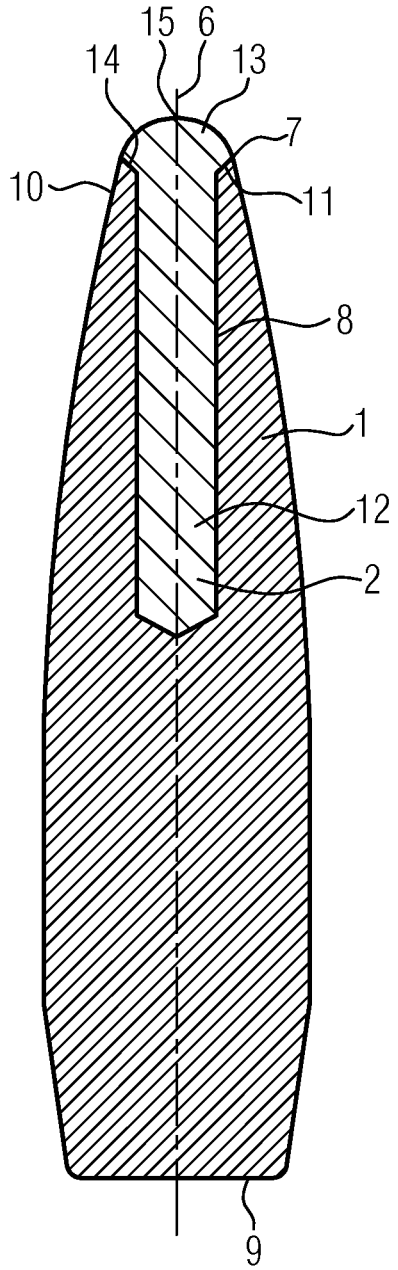
FIG. 1 shows a cross section of an embodiment of a bullet in accordance with the invention.

FIG. 1 shows an embodiment of a lead-free deforming/partially fragmenting projectile according to the invention, having a projectile body 1 and a fragmentable core 2 with a defined mushrooming and fragmenting behavior. In the embodiment shown here, the amount by weight of the fragmentable core 2 of the projectile weight is 3%.

A bore is arranged on the longitudinal axis 6 and extends from the tip 7 of the projectile body 1 into the interior of the projectile body 1. The upper part of the projectile body 1 faces away from the base 9 of the projectile and has a bevel 11 forming at an acute angle with the longitudinal axis 6, extends from the outside circumference 10 of the projectile body 1 to the bore 8. The fragmentable core 2 has a cylindrical part 12 and a head part 13, with the cylindrical part 12 being in the bore 8 and the head part 13 protruding out of the bore 8 and has a support surface 14, which conforms to the beveled surface 11 in the projectile body 1. With the support surface 14, the head part 13 is positioned on the beveled surface 11 of the projectile body 1. The head part 13 has a rounded tip 15, which is the tip of the projectile.

Figure 2:
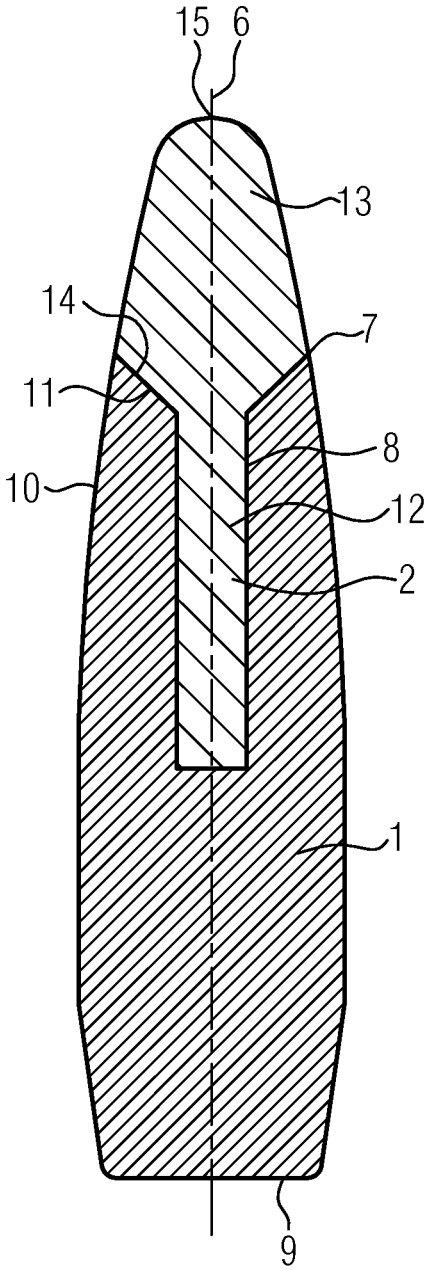
FIG. 2 shows a cross section of another embodiment of a bullet in accordance with the invention.

FIG. 2 shows a cross section of another embodiment of a lead-free deforming/partially fragmenting projectile according to the invention, having a projectile body 1 and a fragmentable core 2 with a defined mushrooming and fragmenting behavior which produces multiple fragments as shown. In the embodiment shown here, the amount by weight of the fragmentable core 2 in the projectile weight is 30%. The same reference numerals also denote the same objects as in FIG. 1.

Figure 3:
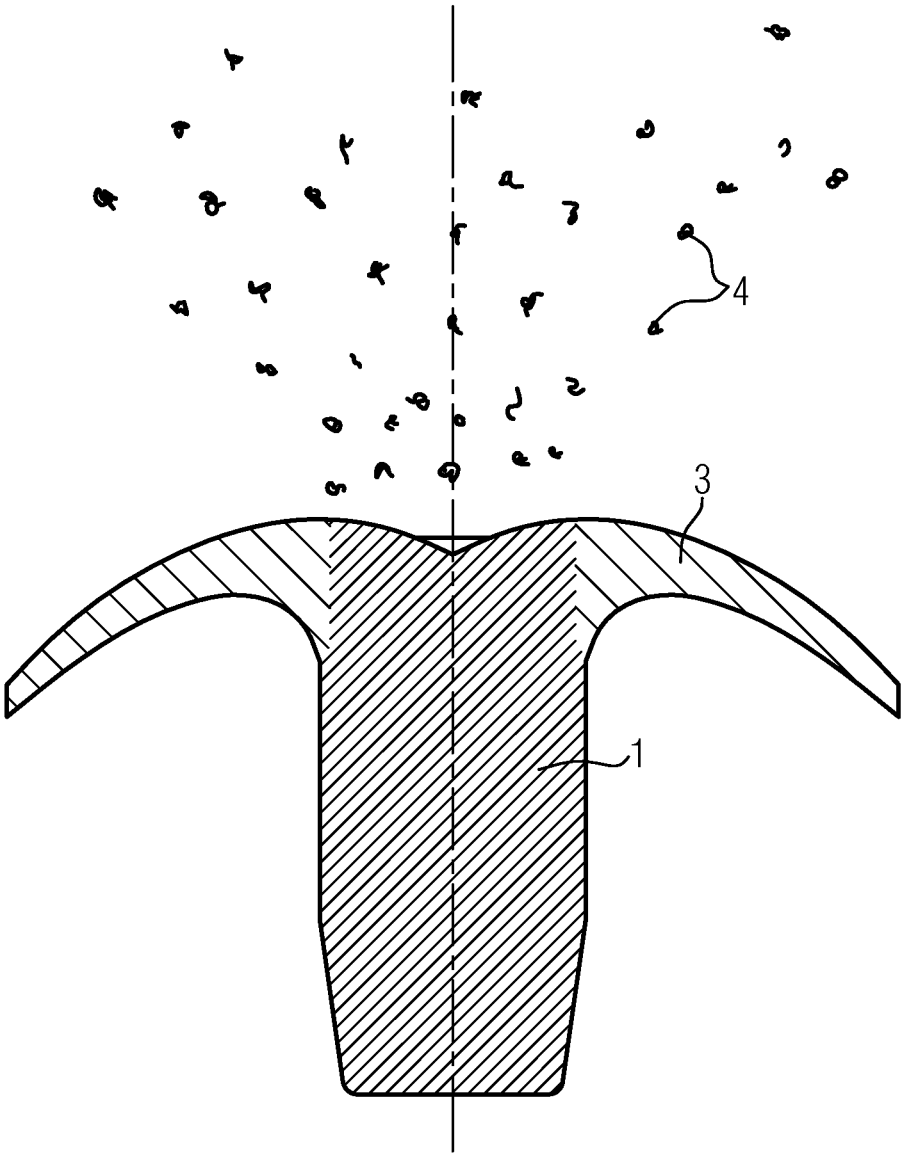

FIG. 3 shows a cross section a bullet in accordance with the invention illustrating the mushrooming effect 3 of the projectile body 1 and the defined fragmentation 4 of the fragmentable core 2 of the projectile in the target body.

The invention claimed is:

1. A lead-free partially deforming and partially fragmenting projectile comprising:

a projectile body configured for mounting in a cartridge including a fragmentable core, a base, a bore disposed on a longitudinal axis of the body and which extends from a tip of the projectile body into an interior of the projectile body, the tip facing away from the base and including a beveled surface which forms an acute angle with the longitudinal axis and which extends from an outer circumference of the projectile body to the bore, the fragmentable core having a cylindrical part and a head part which protrudes out of the bore and has a support surface conforming to the beveled surface and rests on the support surface and the head part has a rounded tip which is the tip of the projectile; and wherein the fragmentable core is deformable and is configured to start mushrooming of the projectile body upon impact with a game animal body after being fired from the cartridge, weighs between 3% and 30% of a weight of the projectile body, consists of tin or pressed tin granules and has predetermined breaking points formed into the core prior to mounting of the projectile body in the cartridge, the breaking points of the core are configured to break upon the impact with the game animal body into fragments which separate from the projectile body into the game animal body while the projectile body passes completely through the game animal body.

2. A projectile in accordance with claim 1, wherein the body consists of deformable lead-free material or alloys thereof.

3. A projectile in accordance with claim 2, wherein the body consists of Cu or CuZn.

4. A projectile in accordance with claim 3, wherein the bore has only a cylindrical surface.

5. The projectile in accordance with claim 3, wherein the bore is entirely filled with the core.

6. A projectile in accordance with claim 2, wherein the bore has only a cylindrical surface.

7. The projectile in accordance with claim 2, wherein the bore is entirely filled with the core.

8. A projectile in accordance with claim 1, wherein the bore has only a cylindrical surface.

9. The projectile in accordance with claim 8, wherein the bore is entirely filled with the core.

10. The projectile in accordance with claim 1, wherein the bore is entirely filled with the core.

* * * * *